United States Patent [19]

Fujiwara

[11] 4,166,531

[45] Sep. 4, 1979

[54] PACKING DEVICE FOR ELECTRIC FAN OF ASSEMBLED TYPE

[75] Inventor: Hirofumi Fujiwara, Moriguchi, Japan

[73] Assignee: Sanyo Electric Co., Ltd., Osaka, Japan

[21] Appl. No.: 890,021

[22] Filed: Mar. 24, 1978

[30] Foreign Application Priority Data

Mar. 24, 1977 [JP] Japan ..... 52-36239[U]
Mar. 24, 1977 [JP] Japan ..... 52-36240[U]

[51] Int. Cl.[2] ..... B65D 85/64; B65D 85/68
[52] U.S. Cl. ..... 206/320; 206/523
[58] Field of Search ..... 206/319, 320, 523, 587, 206/589, 590, 592

[56] References Cited

U.S. PATENT DOCUMENTS

| | | | |
|---|---|---|---|
| 3,088,584 | 5/1963 | Kozikowski | 206/590 |
| 3,243,037 | 3/1966 | Luertzing | 206/592 |
| 3,414,121 | 12/1968 | Suzuki | 206/320 |
| 3,416,648 | 12/1968 | Levi | 206/587 |
| 3,580,467 | 5/1971 | Pieszak | 206/319 |

FOREIGN PATENT DOCUMENTS

| | | | |
|---|---|---|---|
| 1168336 | 10/1969 | United Kingdom | 206/523 |

*Primary Examiner*—Herbert F. Ross
*Attorney, Agent, or Firm*—Armstrong, Nikaido, Marmelstein & Kubovcik

[57] ABSTRACT

A packing device for an electric fan of assembled type, composed of a basic shell having more than two recesses separated from each other and a partially complementaryly recessed holder, which are made of cushioning materials. The basic shell is provided with a first recess for accommodating therein both a blade assembly and a pair of guards in piles, and a second recess positioned next to the first recess for accommodating therein both a casing integrally formed with a supporting arm having a motor and a base portion without making any contact between them when packed as a whole. The base portion is positioned within the either one of vertical side spaces with respect to the supporting arm when the casing integrally formed is accommodated on its side in the second recess.

13 Claims, 7 Drawing Figures

PACKING DEVICE FOR ELECTRIC FAN OF ASSEMBLED TYPE

BACKGROUND OF THE INVENTION

The present invention relates to a packing device, more particularly to a packing device for an electric fan of assembled type.

Recently, some types of electric fans are arranged to be dissembled at least into component parts such as a blade assembly, a pair of guards, a base portion, a casing or a switch box integrally formed with a supporting arm or a pedestal having a motor, etc. or assembled into one unit mainly for conveniences in packing, storing and transportation.

However, even the electric fan of the above described type for domestic use is, in general, voluminous, and the fact that the more powerful the electric fan is, the more bulky the size thereof, in turn, leads to large size of the components or parts for constituting the electric fan to be packed.

Although there have already been proposed quite a number of arrangements concerning packing devices for electric fans of the above described type, these devices are still not only bulky as a whole from the point of view of compact accommodation of the fan components for efficient transportation and storage, but complicated in structure, requiring considerable cost in the manufacturing thereof.

The conventional packing devices as described above generally include a pair of halves or shells, for example, of cushioning materials for accommodation of the fan components. The factors governing the compact configuration of packing devices as a whole are the relative or combined dimensional correlations between the fan components to be packed and the recessed portions to be formed in the halves or shells.

According to the packing device disclosed in Japanese Utility Model Publication No. 40-31594, either one of the halves accommodates corresponding one of the guards, including a blade assembly in the recess, while the fan main body comprising the casing, supporting arm, motor as well as base portion, as a whole, is held between the halves, with its both sides positioned in either of the complementary recesses formed in the both halves, whereby the lateral length of the base portion of the fan main body itself represents the effective width of the packing device itself as well as the longitudinal length of the fan main body itself represents the effective length of said packing device in a direction perpendicular to said base portion. According to another known packing device disclosed in Japanese Utility Model Publication No. 47-14718, on the contrary to the above-mentioned prior art, each guard is accommodated in the recess formed in each half while both guards being positioned in back-to-back relation when packed, and the base portion is included in one recessed portion enclosed with a bowl shape portion of one guard in one of the halves, while the supporting arm having the motor, as a whole, is interposed between the guards when packed, whereby said width is effectively equivalent to the sum of each depth of each of guards positioned in back-to-back relation. In still another arrangement disclosed, for example, in U.S. Pat. No. 3,414,121, each one of the halves of the packing device includes a central recess for accommodating therein the pedestal and one of guards, and the second and third recesses on opposite sides of the central recess for accommodating therein the motor, and the base portion including the casing, respectively, wherein the motor, pedestal and base portion including the casing are accommodated in the central recess and in the second and third recesses, and the bowl shaped guards are accommodated in the central recesses of the halves on both sides of the pedestal in back-to-back relation. In this packing device, said width is effectively equivalent to the front lateral length of the base portion including the casing.

The conventional packing arrangements as described above have such disadvantages that since the width thereof is equivalent either to the front lateral length of the base portion or the corresponding bottom portion, or to the assembled depth of a pair of guards, these packing devices still possess rather large dimensions when in use especially in width owing either to a reason that the base or the corresponding portion can not always be separated from the switch box or the casing in the electric fans of other assembled type, or to a reason that the space for accommodating the fan main body is arranged in a conventional manner such that the fan main body will be interposed between the pair of guards positioned in back-to-back relation.

Another disadvantage of the prior arts as described above is that these packing devices have the pair of nearly perfect complementary box halves or shells. However, for the purpose of fixedly packing or accommodating each dissembled part of the electric fan by means of the device described above, one of the halves is not necessarily formed in nearly perfect complementary shape or configuration related to the other with respect to its inner or outer configuration, but if properly arranged, it may be formed into smaller one with much more shallow, complementary recesses, because one of the halves may be sufficient to be arranged as a holder for holding the parts fixedly accommodated in the recesses against the other half to prevent all such parts accommodated from slipping out of the positions.

SUMMARY OF THE INVENTION

Accordingly, an essential object of the present invention is to provide the packing device for an electric fan of assembled type which includes two shells made of cushioning, expandable materials for accommodating therein dissembled parts of the electric fan, and in which dimensions of the packing device, especially the width thereof is kept as small as possible without causing any contact between the parts packed by taking into account relative or combined dimensional correlations between these parts to be packed and the recesses to be defined for accommodating such parts.

Another important object of the present invention is to provide the packing device of above described type in which one of the shells is adapted to serve as a holder in order to hold the parts accommodated in the recesses against the other shell, wherein said holder forms a complementary portion sufficient to hold the parts at comparatively small area which is partially covering upper side surface of each part accommodated for preventing these parts from slipping out of position.

A further object of the present invention is to provide the packing device of above described type which is simple in structure and compact in size for easy handling and can be manufactured at low cost through simple processing.

In accomplishing these and other objects, according to a preferred embodiment of the present invention, a packing device for an electric fan of assembled type comprises a basic shell having recesses in its either side face, and a partially complementaryly recessed shell or a second shell to hold dissembled parts of the electric fan against said basic shell. Each one of shells is made of cushioning, expandable materials, having recesses defined slightly less in dimensions compared with dimensions of said parts themselves in order to have said parts accommodated may join said basic shell to said second shell and permit engagement with each other.

Said basic shell includes the first recess for accommodating therein a pair of guards and a blade assembly in piles, the second recess positioned next to said first recess for accommodating therein a base portion and a casing integrally formed with a supporting arm having a motor, and at least one more recess for accommodating therein the other smaller parts required for assembling the electric fan or for a portion to handle the packing device as a unit, wherein the second recess is not only divided into at least two defined portions and the remaining portion in order to accommodate the casing, supporting arm and motor therein, but also arranged in a manner such that the base portion is positioned spaced from the supporting arm on the either side of the supporting arm while being vertically located with respect to the supporting arm accommodated on its side.

Furthermore, the abovementioned second shell is formed in a shape which is sufficiently enough in size to simultaneously hold the dissembled parts accommodated in the recesses against the basic shell at the area covering partial upper side surface of each part accommodated in said recesses.

By the arrangements mentioned above, said fan main body and said base portion are being vertically spaced from each other in the same recessed portion in the basic shell without causing any contact between them, thereby keeping the width of the packing device as small as possible, and furthermore, in addition to such a feature, the size of the abovementioned second shell is not complementary to the basic shell, since the shell mentioned above is prepared only for serving as a holder or a protective covering of the parts accommodated, holding the upper projecting portions of each part from the recesses in the basic shell.

BRIEF DESCRIPTION OF THE DRAWINGS

These and other objects and features of the present invention will become apparent from the following description taken in conjunction with the preferred embodiment thereof with reference to the accompanying drawings in which.

Before the description of the present invention proceeds, it is to be noted that like parts are designated by like reference numerals throughout several views of the accompanying drawings.

DETAILED DESCRIPTION OF THE INVENTION

Figure 1:
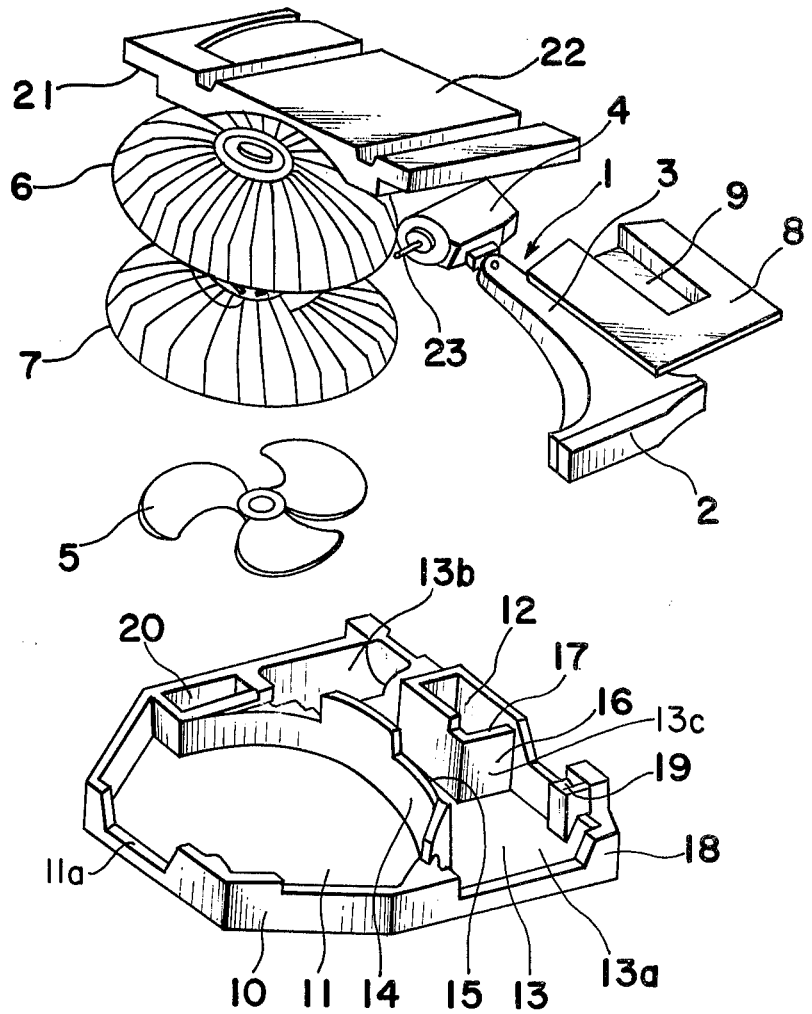
FIG. 1 is an exploded view in perspective of the two shells and the dissembled parts of the electric fan of assembled type.

Referring now to the drawings, there is shown in FIG. 1 a packing device according to one preferred embodiment of the present invention, which includes two shells for accommodating therein dissembled parts or components of an electric fan.

Figure 2:
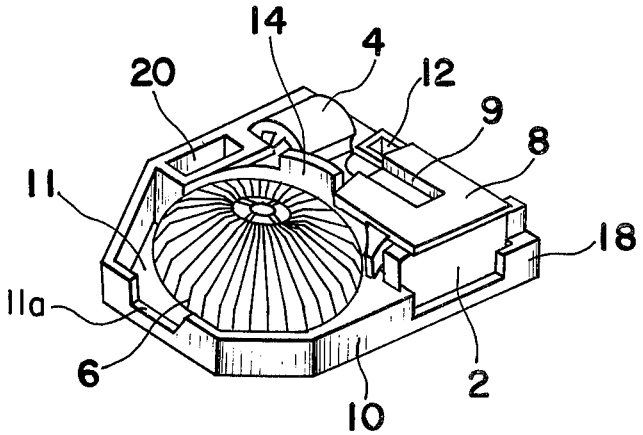
FIG. 2 is a perspective view of the base shell prior to being held by the remaining shell.
Figure 3:
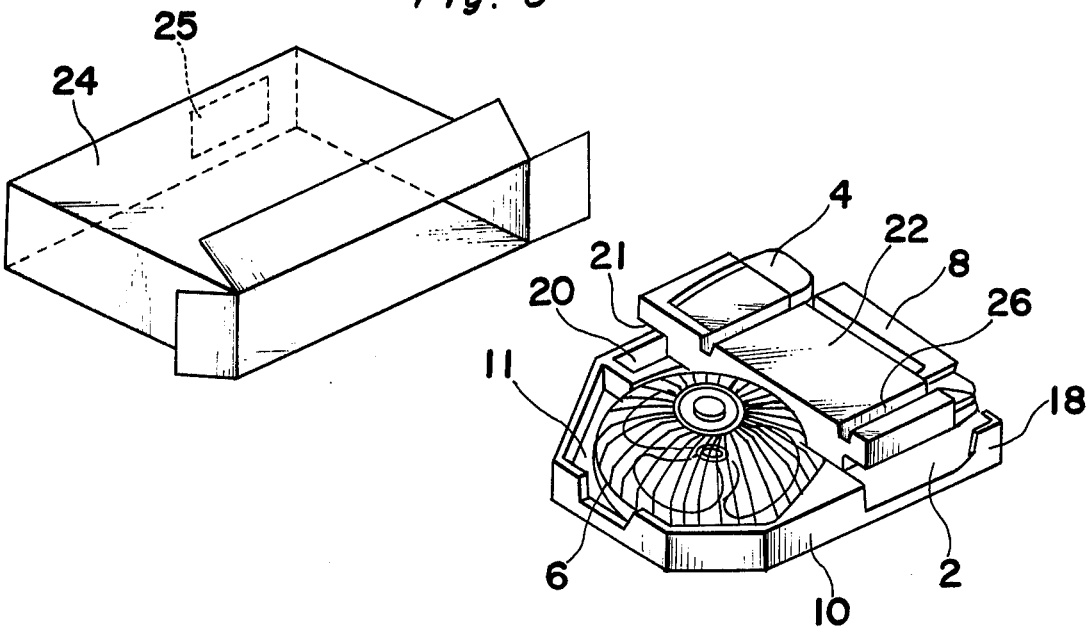
FIG. 3 is a perspective view showing relation between the packing device when packed and its covering box.

Generally, as shown in FIGS. 1 through 3, the electric fan of assembled type includes a base portion 8 of rectangular box-like configuration having a longitudinal recess 9 at the central portion thereof, a casing or switch box 2 integrally formed with a supporting arm 3 and engagable with the recess of the base portion 8, a blade assembly 5 having a plurality of blades and mounted for rotation on a driving shaft 23 of a motor 4 coupled to an upper portion of a supporting arm 3, and front and rear guards 6 and 7 secured to the front portion of the motor 4 for enclosing the blade assembly 5 therein in a known manner.

These parts or components except for smaller parts required for assembling the electric fan, i.e. the base portion 8, the casing 2 integrally formed with the supportng arm 3 having the motor 4 at the top end thereof, the blade assembly 5 and the pair of guards 6 and 7 dissembled as shown in FIG. 1 through 3, are the main components or parts to be packed in the packing device of the present invention having two complementary shells, wherein one of the shells is applied onto the said one shell for holding such components therebetween.

Still referring to FIG. 1, these shells include a first basic shell 10 having recesses generally conforming configuration with the components to be accommodated, and a second shell or holder 22 having much smaller dimensions than the first shell 10 and not being complementary in configuration, to the first basic shell 10. The second shell 22 serves as a holder in a manner mentioned hereinbelow. These two shells 10 and 22 are, in general, made of cushioning and expandable materials such as expandable styrol or the like so as to have one of the shells 22, held the components accommodated in the recesses of the basic shell 10 having slightly less dimensions compared with dimensions of the components to be packed against the basic shell because of its cushioning characteristics, wherein the components accommodated in such a manner as mentioned above will exist as joining means of said shells and permit engagement with each other, after proper pressure having been applied upon both outer surfaces of a complementary unit. The shell 10 of the present embodiment includes a first recess 11 having general configuration of the blade assembly 5 and guards 6 and 7 to be accommodated in piles therein, a second recess 13 positioned next to the first recess 11 and formed among surrounding walls 14 and 16 of the first recess 11 and a recess 12 positioned on opposite side of the first recess 11, and its own wall 18 for accommodating therein a fan main body 1 and the base portion 8 vertically disposed in spaced relation from each other, and two more separated recesses 20 and 21 positioned individually either for accommodating therein the other small parts required for attaching the electric fan as a whole, or for a portion for handling therewith the device when in use, and stepped shoulders 15, 17 and 19 located at each upper end of the surrounding walls of the first and second recesses 11, 13 and the recess 12 in order to have the base portion 8 disposed among stepped shoulders 15, 17 and 19 for the purpose of its accommodation.

The second recess 13 mentioned above as the portion for accommodation of the fan main body 1 and the base portion 8 is divided into three portions, one end portion **13*b* forms a fourth recess which has a general configuration of the motor to be accommodated, and the other end portion 13*a* forms a fifth which is prepared for accommodating therein the casing or the switch box 2 surrounded by the walls 18 and 14. However, the middle portion of said recess 13 has narrow space in width as compared with said two portions in order to accommodate and hold the supporting arm 3 surrounded by the walls 16 and 14. These configuration are formed in advance by interposing the recess 12 between the walls 14 and 18 so as to firmly hold the supporting arm 8**.

Furthermore, the stepped shoulders 15, 17 and 19 provided as mentioned above, wherein the first and the second stepped shoulders 15 and 19 are located at each of the upper ends of the surrounding walls 14 and 18 of the first and second recess 11 and 13 respectively, while the third stepped shoulder 17 is located at the upper end of the surrounding wall 16 of the recess 12. These stepped shoulders 15, 17 and 19 are to support the base portion to be disposed between them for accommodation in a third recess **13*b*** after the parts mentioned above having been accommodated in the above described recesses, respectively. The height of level at which the basic portion is disposed in the above described manner or, in turn, the height of these stepped shoulders, are designed so as to avoid any contact between the parts accommodated in the second recess and the base portion disposed over said parts when in use.

In addition to these recesses and stepped shoulders mentioned above, the shell 10 is provided with the two more recesses, which will be employed as the handling portion of the packing device when in use or the container of the small parts as mentioned above. The conversion of the purposes of utilization between the sixth recess 12 and the recess 20 are capable, because these are only prepared for accommodating therein said smaller parts, and not for the main parts of the electric fan, i.e. the base portion, the blade assembly, and the fan main body.

The base portion located at the certain height from the surface of the second recess 13 are not necessarily supported by the combination of the stepped shoulders mentioned above, but may be altered to be supported by the combinations of two surrounding walls 14 and 16 of the first recess 11 and the recess 12 as well as those of 14 and 18 of the first and the second recesses 11 and 13, depending upon the relative dimensional correlations between parts to be packed and the recesses to be defined for accommodating the parts of the electric fan of similar assembled type.

As described above, only condition required for disposing the base portion is keep it from contact with the rest of the packed parts, especially with the supporting arm of the fan main body, because contacting between them will make the packing device undesirable when to be assembled as a unit.

FIG. 2 shows the state, wherein the parts of the electric fan of assembled type are accommodated in the basic shell 10 with the holder 22 being removed, and the base portion 8 is shouldered by the combination of the stepped shoulders 15, 17 and 19, and thus the base portion 8 is disposed over the recess 13. Furthermore, as shown in both FIG. 1 and FIG. 2, though the recesses are defined to have shapes and dimensions almost corresponding to those of the blade assembly, the guards, the fan main body and the base portion respectively, the depth of each of these recesses is approximately arranged so as to have each upper portion of the parts accommodated in the basic shell project from the upper surface of the basic shell so that the partially complementaryly recessed surface of the holder 22 will receive them when assembled as a unit.

The arrangement mentioned above is necessary for the main parts accommodated to be held and protected by the shell of the packing device and in turn, these parts accommodated will fulfil joining means of the shells.

Furthermore, in this preferred embodiment, whole appearance and configuration of the basic shell 10 is also restricted and not conventional box type, because it is partly constituted with the surrounding walls of the recesses themselves, which leads the whole appearance of the packing device quite compact.

The shell 22 shown in FIG. 1 is not necessarily related perfectly complementary in configuration to the basic shell 10, but it can be formed in much smaller in configuration to have much shallow recesses, because said shell 22 is provided only for holding the parts or components fixedly accommodated in the recesses 11, 12 and 13 against the basic shell 10 in the manner as described in the foregoings for preventing all the parts accommodated from slipping out of positions.

The packing device made from cushioning materials like expandable styrole of the present invention is, in general, formed by means of metal molds and thus, the abovementioned arrangement of the holder 22 which is smaller in configuration will reduce cost of metal mold from the ecconomical point of view.

In the embodiment, as illustrated in FIGS. 1 and 3, the holder 22 having recessed portions in its one face is not perfectly complementary in size with the basic shell 10, but is formed in a rectangular sufficiently enough to hold the parts in the recesses 11, 12 and 13 against the basic shell 10 at the area covering partial upper side surface of each part accommodated in said recesses at the same time to prevent these parts accommodated from slipping out of positions.

In addition to these recessed portions, the holder 22 is provided with the peripherally open stepped portion 21 on one end thereof for making fingers inserted into the seventh recess 20 and then handling the unit when in use. Furthermore, for convenient sake to make the shells into the unit, the shell 22 of the present invention as shown in FIGS. 1 and 3 has a pair of straight recessed portions 26 in the outer side surface of the holder 22 for attaching the holder 22 to the basic shell 10. FIG. 3 illustrates the packing condition of the electric fan of assembled type.

The packing device, thus made as a whole, is then housed in an covering box 24. This covering box 24 has an opening 25 in its outer surface occupying a location which will coincide with said stepped portion 21 of the holder 22 for inserting fingers through the recess 20 so that one can handle the device as a whold when in use.

Figure 4:
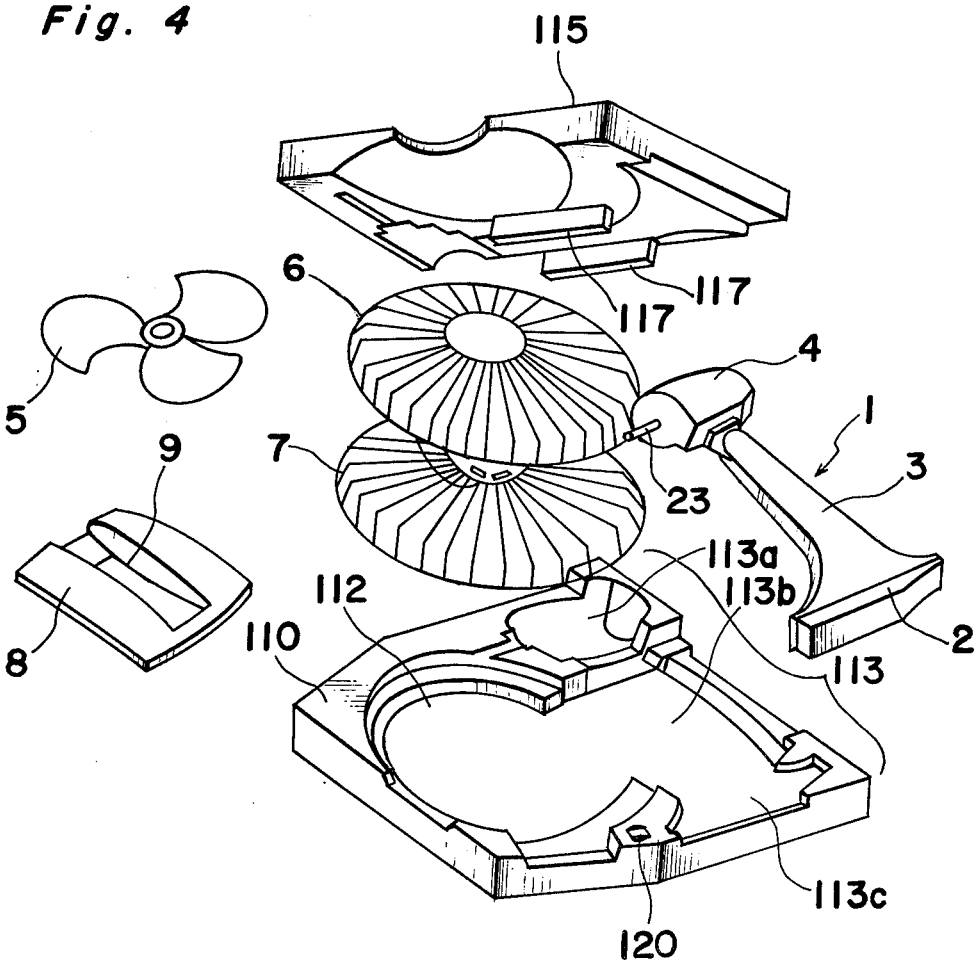
FIG. 4 is an exploded view in perspective of the two shells according to a modification of the packing device of FIGS. 1 to 3, with dissembled parts of the electric fan to be accommodate therein.

Referring now to FIG. 4, there is shown a modified embodiment of the present invention, wherein a basic shell 110 includes a first recess 112 for the same purpose as that of the first recess mentioned in the first embodiment, a second recess 113 positioned next to the first recess 112 for accommodating therein the base portion 8 and the fan main body 1 vertically disposed in spaced relation from each other, and a recess 120 for accommodating therein said remaining smaller parts though the supporting arm 3 is disposed over a portion 113*b* between two portions 113*a* and 113*c*, and is held by projected layers 117 provided in the other shell 115 mentioned hereinbelow.

Futhermore, in this modification, the second recess 113 comprises three portions 113*a*, 113*b* and 113*c* having general configuration of the motor 4, the casing 2 and the base portion 8 to be accommodated. Each portion of the recess 113 is arranged to have average depth among the portions themselves so that not only the supporting arm 3 of the fan main body 1 may be held by both the motor 4 and the casing 2 separately positioned at each end of the second recess 113 when these are in positions in the basic shell 110, but also the supporting arm stretching across in a position may be positioned a little over the base portion 8. This disposition also avoids undesirable contacting between the supporting arm and the parts accommodated.

Figure 5:
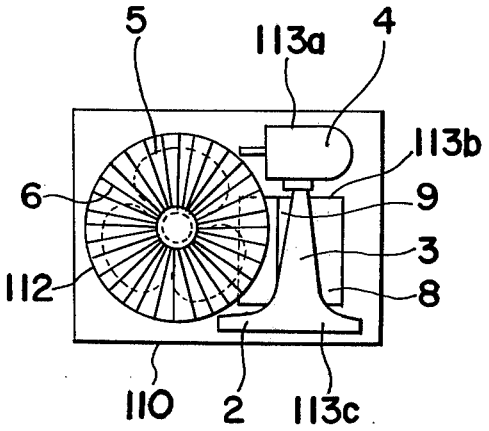
FIG. 5 is a top plain view of the basic shell of FIG. 4 prior to being closed and held by the remaining shell.

FIG. 5 shows the dispositions of the parts accommodated in the basic shell 110 prior to being closed and held by the holder mentioned hereinbelow.

Figure 6:
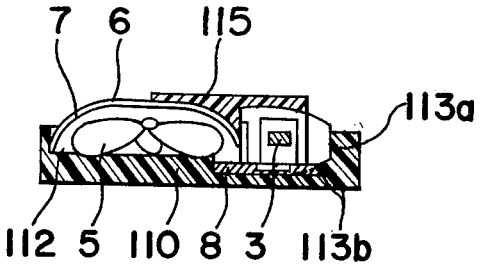
FIG. 6 is a side view in section of the packing device of FIG. 4 after the basic shell being closed and held by the remaining shell.
Figure 7:
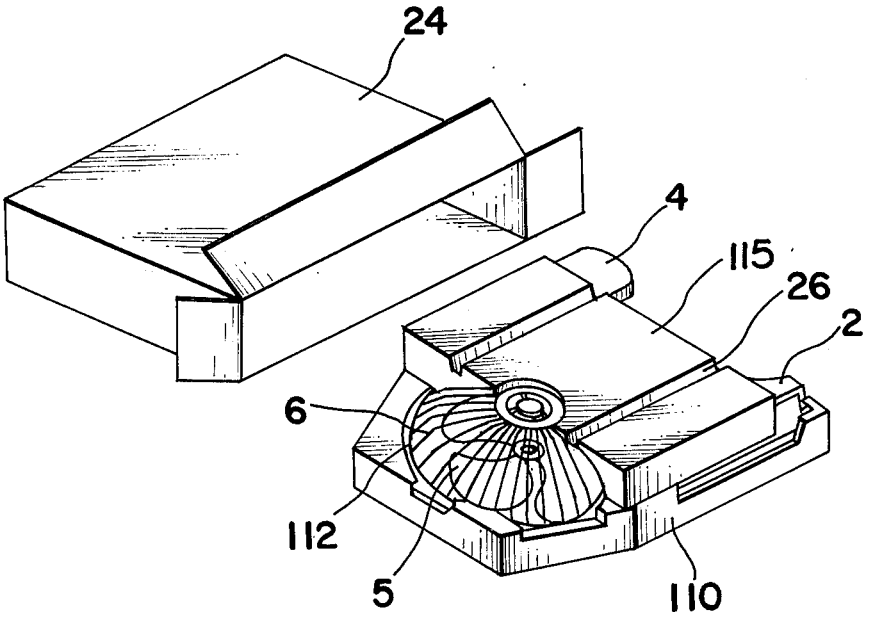
FIG. 7 is an elevational view in perspective of the packing device of FIG. 4 and its covering box.

A complementary shell or a second shell for this modification is shown in FIGS. 4, 6 and 7, the purpose of this shell 115 is also to serve as a holder of the basic shell 110, and is provided with the partially recessed portions and a pair of spaced projections 117 having the distance which is equivalent to the lateral width of the supporting arm to be held therebetween, wherein the supporting arm 3 is held by means of the two projected layers 117.

Furthermore, the height of the pair of projected layers 117 is so adjusted as to suit the depth which is high enouth to reach the upper surface of the base portion 8 accommodated and fix it downwards in position against the basic shell 110 when the device is in use. It is clear that in this modification, the basic shell 110 and the holder 115 are mainly joined by means of the tightly fixed supporting arm 3 between the two layers 117 projected from the surface of the holder 115 mentioned above and its integrally formed both ends, on the contrary, accommodated in the other shell 110. FIG. 6 illustrates this situation, where the complementary shell 15 covers the partial portion of the guards 6 and 7 including the blade assembly 5, while the whole sectional dimensions of the supporting arm 3 is enclosed with the projected layers 117 except for its one side surface facing the bottom plate.

As is clear from the foregoing description, the packing device of the present invention for an electric fan of assembled type comprising the basic shell having recesses, and its recessed holder which are preferably made of cushioning materials, said basic shell including the first recess for accommodating therein the pair of guards and the blade assembly in piles, the second recess for accommodating therein the base portion and the casing integrally formed both with the supporting arm and the motor, and at least one more recess for accommodating therein the remaining smaller parts required for assembling the electric fan as a unit, or for a portion to handle therewith the packing device as a unit, wherein not only the second recess is divided into at least two defined portions and the remaining portion for accommodating therein the casing and the supporting arm and the motor, but also the second recess is arranged to have the base portion being positioned spaced from the supporting arm on either side of the supporting arm while being vertically located in the direction to the disposition of the supporting arm accommodated on its side.

The abovementioned recessed shell is formed in a shape which is sufficiently enouth in size to simultaneously hold the dissembled parts accommodated in said recesses. By the arrangements mentioned above, said fan main body and said base portion are vertically spaced from each other in the same recessed portion in the basic shell without causing any contact between them and furthermore, in addition to this feature, the size of the above-mentioned recessed shell is not related complementary in configuration to the basic shell, since the complementary shell mentioned above is just prepared for serving as the holder of the parts accommodated.

Although the present invention has been fully described by way of example with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. A packing device and a disassembleable electric fan therefore said electric fan comprising a supporting arm having a casing portion for housing switch means and supporting a driving motor, a separable base portion for holding said supporting arm, said base portion having a longitudinal recess on an upper face thereof for receiving said casing portion when said fan is assembled, a blade assembly and a pair of guards, said packing device comprising a first shell formed of a cushioning material having a first recess for accommodating therein said blade assembly and said pair of guards stacked with one on top of the other, a second recess for accommodating therein said supporting arm wherein said first and second recesses are positioned with respect to one another such that said blade assembly and guards do not overlap said supporting arm, and a third recess for accommodating therein said base portion, said third recess being positioned with respect to said second recess such that said base portion and said supporting arm overlap with each other and are spaced from one another, and a second shell formed of said cushioning material, said second shell being engageable with said first shell for holding said fan components between said first and second shells.

2. A packing device as claimed in claim 1, wherein said second recess for accommodating therein said supporting arm includes a fourth recess for accommodating said driving motor therein and a fifth recess for accommodating said casing portion of said supporting arm therein and wherein, said third recess for accommodating therein said base portion is positioned between said fourth and fifth recesses.

3. A packing device as claimed in claim 1, wherein said supporting arm overlaps said base and wherein said second shell includes a pair of spaced projections spaced apart by a distance which is equivalent to the lateral width of said supporting arm which is held therebetween, said projections extending from said second shell by a distance sufficient to contact said base portion and hold said base portion in said first shell.

4. A packing device as claimed in claim 1, wherein said second recess includes a first wall in common with said first recess, said first shell including a sixth recess for accommodating therein attaching members, said sixth recess being positioned on the side of said second recess opposite to said first wall said supporting arm being held between said first wall of said first recess and a wall of said sixth recess, wherein each of said first wall and a second wall of said second recess include at least one stepped shoulder at the upper end thereof, whereby said third recess extends over said second recess, and said base portion is shouldered by said stepped shoulders without contacting said supporting arm.

5. A packing device as claimed in claim 4, wherein a second shoulder is provided at an upper end of said wall of said sixth recess said first and second shoulders supporting said base portion thereon.

6. A packing device as claimed in claim 1, wherein said second shell is a rectangular having an area partially covering each of said components accommodated in said first shell, the longitudinal axis of which is parallel to the longitudinal direction of said supporting arm in said second recess.

7. A packing device as claimed in claim 1, wherein the shape of said first recess in said first shell is circular to receive both of said blade assembly and said guards therein.

8. A packing device as claimed in claim 1, wherein the outer surface of said first shell comprises surrounding walls surrounding said recesses, whereby the overall appearance of said shell is made compact.

9. A packing device as claimed in claim 1, wherein a pair of recessed portions is provided in an outer side face of said second shell wherein said second shell is formed against said first shell when assembling said first shell and said second shell as one unit.

10. A packing device as claimed in claim 1, including a seventh recess for forming a handle when said first and second shells are assembled as one unit.

11. A packing device as claimed in claim 1, wherein said second shell including a portion outwardly stepped at one longitudinally peripheral end thereof for allowing fingers to be inserted into said seventh recess when said shells are assembled.

12. A packing device as claimed in claim 1, wherein said shells when assembled are housed in a covering box having an opening in its outer face, the location of which coincides with said outwardly stepped portion of said second shell for inserting fingers through it into said seventh recess.

13. A packing device as claimed in claim 1, wherein said second recess includes a first wall in common with said first recess, wherein each of said first wall and a second wall of said second recess include at least one stepped shoulder at the upper end thereof, whereby said third recess extends over said second recess, and said base portion is shouldered by said stepped shoulders without contacting said supporting arm.

* * * * *